US007104713B2

(12) United States Patent
Hoshino et al.

(10) Patent No.: US 7,104,713 B2
(45) Date of Patent: Sep. 12, 2006

(54) PRINTER FOR A HEAT-SENSITIVE ADHESIVE SHEET

(75) Inventors: Minoru Hoshino, Chiba (JP); Norimitsu Sanbongi, Chiba (JP); Tatsuya Obuchi, Chiba (JP); Yoshinori Sato, Chiba (JP)

(73) Assignee: Seiko Instruments Inc., (JP)

( * ) Notice: Subject to any disclaimer, the term of this patent is extended or adjusted under 35 U.S.C. 154(b) by 138 days.

(21) Appl. No.: 10/965,121

(22) Filed: Oct. 14, 2004

(65) Prior Publication Data

US 2006/0083573 A1 Apr. 20, 2006

(51) Int. Cl.
*B41J 11/70* (2006.01)

(52) U.S. Cl. ..... 400/621; 347/218; 347/171; 347/172; 347/174; 347/175; 347/221; 347/202; 400/120.1; 400/120.14

(58) Field of Classification Search ..... 347/171, 347/172, 174, 175, 202, 218, 221; 400/120.1, 400/120.14
See application file for complete search history.

(56) References Cited

U.S. PATENT DOCUMENTS

RE37,726 E * 6/2002 Tanaka et al. ..... 400/120.18
6,462,765 B1 * 10/2002 Conwell et al. ..... 347/171
6,867,792 B1 * 3/2005 Hoshino et al. ..... 347/218
6,875,955 B1 * 4/2005 Yoshida et al. ..... 219/216
6,885,390 B1 * 4/2005 Hoshino et al. ..... 347/171
7,025,518 B1 * 4/2006 Hoshino et al. ..... 400/621
2003/0189631 A1 * 10/2003 Hoshino et al. ..... 347/218
2004/0257424 A1 * 12/2004 Nureki ..... 347/187
2004/0257428 A1 * 12/2004 Sato et al. ..... 347/220
2005/0189076 A1 * 9/2005 Takahashi et al. ..... 156/359
2005/0269033 A1 * 12/2005 Kohira et al. ..... 156/538

* cited by examiner

*Primary Examiner*—Ren Yan
*Assistant Examiner*—Matthew Marini
(74) *Attorney, Agent, or Firm*—Adams & Wilks

(57) ABSTRACT

A printer has a sheet housing unit for storing a heat-sensitive adhesive sheet having a heat-sensitive adhesive layer on one side and a printable surface on the other side. A set of pull-out rollers pulls the heat-sensitive adhesive sheet out of the sheet housing unit and transports the sheet in a given direction, and a cutter device cuts the heat-sensitive adhesive sheet that has been transported by the pull-out rollers. A printing device has a thermal print head for printing letters or images on the printable surface of the heat-sensitive adhesive sheet, and a print platen roller for transporting the heat-sensitive adhesive sheet in the given direction. A thermal activation device has a thermal-activation thermal head for heating the heat-sensitive adhesive layer, and a thermal activation platen roller for transporting the heat-sensitive adhesive sheet in the given direction. A first drive unit drives the pull-out rollers and a second drive unit drives the print platen roller. A drive control device controls the first drive unit and the second drive unit independently of each other.

8 Claims, 11 Drawing Sheets

PRINTER FOR A HEAT-SENSITIVE ADHESIVE SHEET

BACKGROUND OF THE INVENTION

1. Field of the Invention

The present invention relates to a printer equipped with a thermal activation device for a heat-sensitive adhesive sheet having a heat-sensitive adhesive layer which is normally non-adhesive and exhibits adhesion only when heated is formed on one side of a sheet-like base material to be used as, for example, an adhesive label. More specifically, the present invention relates to a thermal printer having a thermal head as printing means.

2. Description of the Related Art

Thermal activation sheets (print medium in which a coat layer containing a thermal activation component is formed on the surface, for example, heat-sensitive adhesive sheets) have recently become available as sheets attached to merchandises, and are used in wide fields. Examples of uses of thermal activation sheets include POS sheets for food products, delivery address sheets, sheets bearing medical information, baggage tags, and labels of bottles and cans.

Those heat-sensitive adhesive sheets are composed of a sheet-like base material one side of which has a heat-sensitive adhesive layer and the other side of which is a printable surface. The heat-sensitive adhesive layer is normally non-adhesive and exhibits adhesion when heated.

As a printer for such heat-sensitive adhesive sheets, a printer is proposed which has a thermal activation device which heats a heat-sensitive adhesive layer of a heat-sensitive adhesive label by bringing a head that has resistors (heater elements) on a ceramic substrate as heat sources, e.g., a thermal head for use as a print head in a thermal printer, into contact with the label (JP 11-79152 A).

Now, a description is given on a common structure of a conventional printer for a heat-sensitive adhesive sheet with the use of a thermal printer P shown in FIG. 11.

The thermal printer P in FIG. 11 is composed of: a roll housing unit 10 for holding a tape-like, heat-sensitive adhesive label 70 wound into a roll; a printing unit 50 for printing on the heat-sensitive adhesive label 70; a cutter unit 30 for cutting the heat-sensitive adhesive label 70 into pieces of given length; and a thermal activation unit 60 which serves as a thermal activation device for thermally activating a heat-sensitive adhesive layer of the heat-sensitive adhesive label 70.

The printing unit 50 is composed of: a thermal print head 51 having heater elements which are constituted of relatively small resistors arranged along the width for dot printing; a print platen roller 52 pressed against the thermal print head 51; and other components. In FIG. 11, the print platen roller 52 is rotated clockwise and the heat-sensitive adhesive label 70 is transported to the right hand side of the drawing.

The cutter unit 30 is for cutting the heat-sensitive adhesive label 70 into pieces of suitable length after letters or images are printed on the label by the printing unit 50. The cutter unit 30 is composed of a movable blade 31 operated by a not-shown drive source such as an electric motor, a stationary blade 32 facing the movable blade 31, and other components.

The thermal activation unit 60 is composed of a thermal-activation thermal head 61 having heater elements, a thermal activation platen roller 62 for transporting the heat-sensitive adhesive label 70, and other components. In FIG. 11, the thermal activation platen roller 62 is rotated in a direction opposite the direction in which the print platen roller 52 is rotated (the platen roller 62 is rotated counterclockwise) to transport the heat-sensitive adhesive label 70 to the right hand side of the drawing.

To cut the heat-sensitive adhesive label 70 with the cutter unit 30 in the thermal printer P structured as above, transport of the label 70 has to be stopped for a time period necessary for the movable blade 31 to move up and down (0.4 sec., for example) In other words, the cutter unit 30 cannot perform the cutting operation unless the print platen roller 52 and the thermal activation platen roller 62 stop rotating.

For that reason, in the case where, for example, the label length is longer than the distance between a cutting position of the cutter unit 30 and the thermal-activation thermal head 61, transport of the heat-sensitive adhesive label 70 is stopped with the label 70 nipped between the thermal-activation thermal head 61 and the thermal activation platen roller 62. This causes the heat-sensitive adhesive layer that has exhibited adhesion to stick to the thermal-activation thermal head 61 and prevents smooth transport when the transport of the label is resumed after cutting, leading to transport failures such as paper jam. Another problem is that heat from the thermal-activation thermal head 61 could transfer to the printable layer (heat-sensitive color-developing layer) of the heat-sensitive adhesive label 70 and cause the layer to develop color.

In this case, even if the label is successfully discharged from the printer, the label's appearance has been spoiled and the label is no longer fit for use. If the heat-sensitive adhesive layer is stuck firmly to the thermal-activation thermal head 61, the processing has to be canceled to fix the printer.

SUMMARY OF THE INVENTION

The present invention has been made in view of the above, and an object of the present invention is therefore to provide a printer for a heat-sensitive adhesive sheet which is capable of cutting a heat-sensitive adhesive sheet into pieces of given length without allowing the sheet to stay nipped between a thermal-activation thermal head and a thermal activation platen roller, which is placed to face the thermal-activation thermal head, when transport of the sheet is stopped.

The present invention has been made in order to achieve the above-mentioned object. A printer for a heat-sensitive adhesive sheet according to an aspect of the present invention includes: a sheet housing unit for storing a heat-sensitive adhesive sheet with a sheet-like base material one side of which has a heat-sensitive adhesive layer formed thereon and the other side of which serves as a printable surface; pull-out rollers for pulling the heat-sensitive adhesive sheet out of the sheet housing unit to transport the sheet in a given direction; a cutter device placed downstream of the pull-out rollers and having cutting means which cuts the heat-sensitive adhesive sheet that has been transported by the pull-out rollers; a printing device placed downstream of the cutter device and having a thermal print head and a print platen roller, the thermal print head being provided to print letters or images on a printable surface of the heat-sensitive adhesive sheet, the print platen roller transporting the heat-sensitive adhesive sheet in a given direction; a thermal activation device placed downstream of the printing device and having a thermal-activation thermal head and a thermal activation platen roller, the thermal-activation thermal head heating the heat-sensitive adhesive layer, the thermal activation platen roller transporting the heat-sensitive adhesive sheet in a given direction; a sheet pooling portion placed between the cutter device and the printing device and having a space in which a given length of the heat-sensitive adhesive sheet is bowed; a first drive means for driving the pull-out rollers; a second drive means for driving the print platen roller; and a drive control device which can control the first drive means and the second drive means independently of each other.

According to this printer for a heat-sensitive adhesive sheet, it is possible to make a heat-sensitive adhesive sheet bow temporarily in the sheet pooling portion by controlling the transport speed of the pull-out rollers and of the print platen roller appropriately, so that a portion of the sheet that is bowed in the sheet pooling portion is sent forward by the print platen roller while the heat-sensitive adhesive sheet is being cut. Therefore, no other roller than the pull-out roller has to stop its operation to cut the sheet.

This enables the cutter device to cut a heat-sensitive adhesive sheet while the sheet is transported by the thermal activation platen roller or before the leading edge of the sheet reaches the thermal-activation thermal head. As a result, problems such as paper jam in which the heat-sensitive adhesive sheet is stuck to the thermal-activation thermal head can be solved and additional maintenance works for removing a jammed label are eliminated. Sticker labels can thus be prepared with a markedly improved efficiency.

Specifically, a heat-sensitive adhesive sheet is temporarily bowed for a given length between the cutter device and the printing device by setting the transport speed of the print platen roller slower than the transport speed of the pull-out rollers, or by stopping the print platen roller for a predetermined period of time. While the common practice is to transport a heat-sensitive adhesive sheet paying attention not to sag the sheet in order to avoid transport failures, the present invention intentionally makes a heat-sensitive adhesive sheet bow for a given length by setting different transport speeds for the pull-out rollers and the print platen roller.

In the printer for a heat-sensitive adhesive sheet, the thermal activation platen roller is connected to the second drive means. As a result, the print platen roller and the thermal activation platen roller are driven by one drive source. This simplifies the drive and facilitates control of the drive source. In addition, the transport speed of the print platen roller and the transport speed of the thermal activation platen roller can easily be synchronized with each other, thereby preventing the occurrence of transport failures such as paper jam due to a difference in transport speed between the print platen roller and the thermal activation roller.

A printer for a heat-sensitive adhesive sheet according to another aspect of the present invention, includes: a sheet housing unit for storing a heat-sensitive adhesive sheet with a sheet-like base material one side of which has a heat-sensitive adhesive layer formed thereon and the other side of which serves as a printable surface; pull-out rollers for pulling the heat-sensitive adhesive sheet out of the sheet housing unit to transport the sheet in a given direction; a cutter device placed downstream of the pull-out rollers and having cutting means which cuts the heat-sensitive adhesive sheet that has been transported by the pull-out rollers; a printing device placed downstream of the cutter device and having a thermal print head and a print platen roller, the thermal print head being provided to print letters or images on the printable surface of the heat-sensitive adhesive sheet, the print platen roller transporting the heat-sensitive adhesive sheet in a given direction; a thermal activation device placed downstream of the printing device and having a thermal-activation thermal head and a thermal activation platen roller, the thermal-activation thermal head heating the heat-sensitive adhesive layer, the thermal activation platen roller transporting the heat-sensitive adhesive sheet in a given direction; a sheet pooling portion placed between the printing device and the thermal activation device and having a space in which a given length of the heat-sensitive adhesive sheet is bowed; a first drive means for driving the pull-out rollers; a second drive means for driving the thermal activation platen roller; and a drive control device which can control the first drive means and the second drive means independently of each other.

According to this printer for a heat-sensitive adhesive sheet, it is possible to make a heat-sensitive adhesive sheet bow temporarily in the sheet pooling portion by controlling the transport speed of the print platen roller and of the thermal activation platen roller appropriately, so that a portion of the sheet that is bowed in the sheet pooling portion is sent forward by the thermal activation platen roller while the heat-sensitive adhesive sheet is being cut. Therefore, only the pull-out rollers and the print platen roller have to stop its operation to cut the sheet.

This enables the cutter device to cut a heat-sensitive adhesive sheet while the sheet is transported by the thermal activation platen roller or before the leading edge of the sheet reaches the thermal-activation thermal head. As a result, problems such as paper jam in which the heat-sensitive adhesive sheet is stuck to the thermal-activation thermal head can be solved and additional maintenance works for removing a jammed label are eliminated. Sticker labels can thus be prepared with a markedly improved efficiency.

Specifically, a heat-sensitive adhesive sheet is temporarily bowed for a given length between the cutter device and the printing device by setting the transport speed of the thermal activation platen roller slower than the transport speed of the print platen roller, or by stopping the thermal activation platen roller for a predetermined period of time.

In the printer for a heat-sensitive adhesive sheet, the pull-out rollers are connected to the second drive means. This simplifies the device and facilitates control of the drive sources. In addition, the transport speed of the pull-out rollers and the transport speed of the print platen roller can easily be synchronized with each other, thereby eliminating transport failures such as paper jam due to a difference in transport speed between the pull-out rollers and the print platen roller.

The printer for a heat-sensitive adhesive sheet further includes pull-in rollers which are placed upstream of the thermal activation platen roller to transport the heat-sensitive adhesive sheet in a given direction. This makes it possible to prevent transport failures while the heat-sensitive adhesive sheet is carried from the printing device to the thermal activation device and thus improves the reliability in sheet transport. It is particularly effective in a printer that has a label pooling portion between a printing device and a thermal activation device as in the third aspect of the present invention.

In the printer for a heat-sensitive adhesive sheet, the pull-in rollers are connected to the second drive means. As a result, an additional drive source for the pull-in rollers is not necessary, leading to simplification of the device and to easier control of a drive source.

The printer for a heat-sensitive adhesive sheet further includes detecting means which is placed upstream of the thermal activation platen roller to detect a heat-sensitive adhesive sheet. This makes it possible to time a timing for a change in transport speed (or stoppage) of the print platen roller or the pull-out rollers with a timing of actual detection of the leading edge of the heat-sensitive adhesive sheet. The transport speed can therefore be controlled more precisely than when the timing is calculated from the transport length or transport time of the heat-sensitive adhesive sheet.

DETAILED DESCRIPTION OF THE PREFERRED EMBODIMENTS

Preferred embodiments of the present invention are described below in detail with reference to the drawings.

FIRST EMBODIMENT

Figure 1:
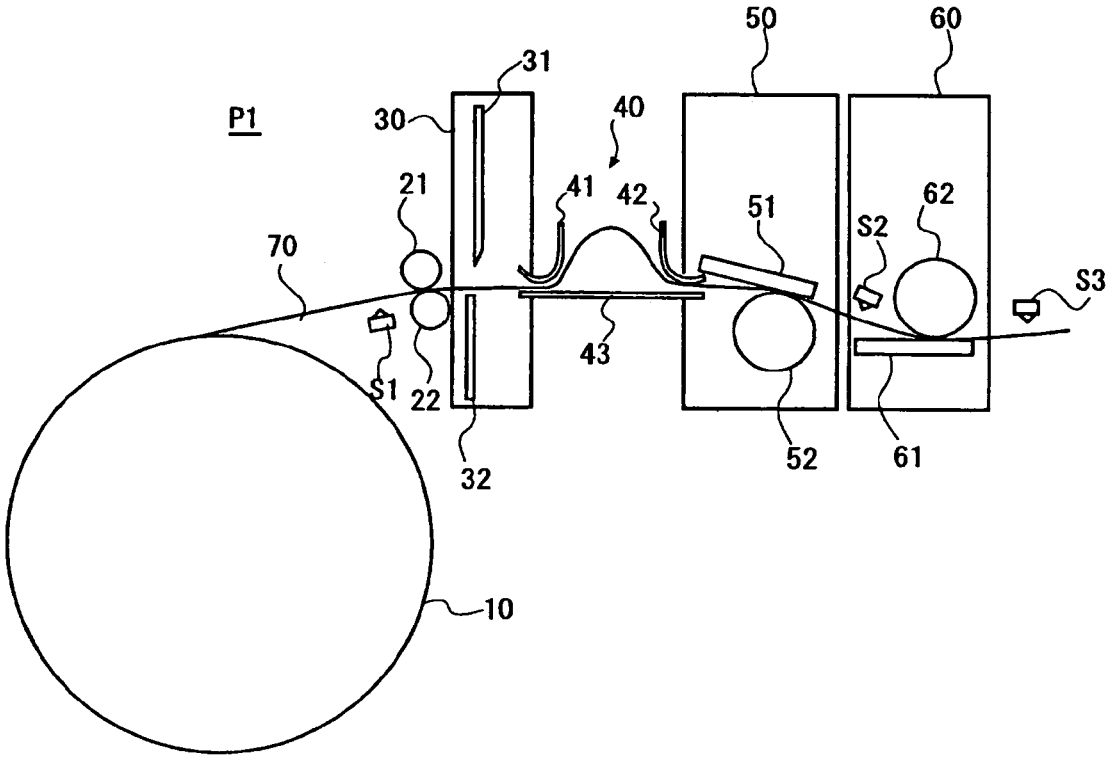
FIG. 1 is a schematic diagram showing a structural example of a thermal printer P1 according to a first embodiment of the present invention.

FIG. 1 is a schematic diagram showing the structure of a thermal printer P1 for a heat-sensitive adhesive sheet according to a first embodiment. The thermal printer P1 is composed of: a roll housing unit 10 for holding a tape-like, heat-sensitive adhesive label 70 wound into a roll; a cutter unit 30 for cutting the heat-sensitive adhesive label 70 into pieces of given length; a printing unit 50 for printing on the heat-sensitive adhesive label 70; a thermal activation unit 60 which serves as a thermal activation device for thermally activating a heat-sensitive adhesive layer of the heat-sensitive adhesive label 70; and other components.

No particular limitations are put on the heat-sensitive adhesive label 70 used in this embodiment, and the label 70 could be any heat-sensitive adhesive label as long as it is composed of a label-like base material having on its front side a heat insulating layer and a heat-sensitive, color-developing layer (printable layer) and having on its back side a heat-sensitive adhesive layer, which is obtained by applying and drying a heat-sensitive adhesive. The heat-sensitive adhesive constituting the heat-sensitive adhesive layer mainly contains thermoplastic resin, solid plastic resin, or the like. The heat-sensitive adhesive label 70 may not have the heat insulating layer, or may have a protective layer or a colored printed layer (a layer on which letters or images are already printed) formed on a surface of the heat-sensitive, color-developing layer.

In this embodiment, feeders 21 and 22 serving as pull-out rollers are placed upstream of the cutter unit 30 and are pressed against each other. The feeders 21 and 22 are connected to a first stepping motor 110 (see FIG. 3) through a not-shown gear transmission mechanism. As the first stepping motor 110 drives and rotates the feeders 21 and 22, the heat-sensitive adhesive label 70 is transported to the cutter unit 30.

Placed along a transport path from the cutter unit 30 to the printing unit 50 is a guide unit 40, which is composed of a plate-like first guide 43 and second guides 41 and 42 bent upward at approximately 90°. The second guide 42 is positioned at an exit of the cutter unit 30 and the second guide 42 is positioned at an entrance of the printing unit 50. A space between the second guides 41 and 42 is open and constitutes a label (sheet) pooling portion where a given amount of the heat-sensitive adhesive label 70 is temporarily bowed. The guide unit 40 ensures that the heat-sensitive adhesive label 70 is bowed in the label (sheet) pooling portion without fail.

The second guides 41 and 42 serving as a label (sheet) pooling portion may be one member that has a concave portion in its upper part. The first guide 43 and the second guides 41 and 42 may switch positions so that the first guide 43 is placed above the second guides 41 and 42. In this case, the label pooling portion is positioned below the label transport path. The bow of the label is performed by controlling the transport speed of the feeders 21 and 22 and the transport speed of a print platen roller 52 (a thermal activation platen roller 62) as will be explained later.

The cutter unit 30 is for cutting the heat-sensitive adhesive label 70 which has been pulled out of the roll housing unit 10 and transported by the feeders 21 and 22 into pieces of suitable length. The cutter unit 30 is composed of a movable blade 31, which is driven by a cutter drive unit 108 (see FIG. 2), a stationary blade 32, which faces the movable blade 31, and other components.

The printing unit 50 is composed of: a thermal print head 51 having heater elements which are constituted of relatively small resistors arranged along the width for dot printing; the print platen roller 52 pressed against the thermal print head 51; and other components. The thermal print head 51 is placed downstream of the cutter unit 30 and the guide unit 40. A detailed description of the heater elements will be omitted since the heater elements here are identical in structure with those of a print head in a known thermal printer in which a protective film made of crystalline glass covers surfaces of heating resistive elements formed on a ceramic substrate by a thin film technique.

The print platen roller 52 is connected to a second stepping motor 111 (see FIG. 3) through a not-shown gear transmission mechanism. As the second stepping motor 111 drives and rotates the print platen roller 52, the heat-sensitive adhesive label 70 is transported to the thermal activation unit 60. The printing unit 50 has not-shown pressurizing means, which is composed of a coil spring, a leaf spring, or the like. The resilience of the pressurizing means presses the thermal print head 51 against the print platen roller 52. The rotation axis of the print platen roller 52 is kept parallel to the direction in which the heater elements are aligned, so that the pressure applied to the heat-sensitive adhesive label 70 from the thermal print head 51 is made uniform along the entire width of the label 70.

The thermal activation unit 60 is placed downstream of the printing unit 50, and is composed of a thermal-activation thermal head 61 having heater elements to serve as heating means, and the thermal activation platen roller 62 to serve as transporting means for transporting the heat-sensitive adhesive label 70. Although omitted from this embodiment, a pair of pull-in rollers may be provided in order to pull the heat-sensitive adhesive label 70 fed from the printing unit 50 into the gap between the thermal-activation thermal head 61 and the thermal activation platen roller 62.

The thermal-activation thermal head 61 of this embodiment is identical in structure with the thermal print head 51, in other words, a print head of a known thermal printer in which a protective film made of crystalline glass covers surfaces of heating resistive elements formed on a ceramic substrate by a thin film technique. By employing the thermal-activation thermal head 61 that is structured the same way as the print thermal head 51, it is possible to use parts common to the two and thereby reduce cost. However, there is no need for the heater elements of the thermal-activation thermal head 61 to be separated on a dot-by-dot basis unlike the heater elements of the print thermal head 51 and the thermal-activation thermal head 61 can have continuous resistors.

Similar to the print platen roller 52, the thermal-activation thermal head 61 is connected to the second stepping motor 111 (see FIG. 3) through a not-shown gear transmission mechanism. As the second stepping motor 111 drives and rotates the thermal activation platen roller 62, the heat-sensitive adhesive label 70 is discharged from the printer P1. Connected to the second stepping motor 111 through the given gear, the thermal activation platen roller 62 is rotated in a direction opposite the rotation direction of the print platen roller 52. Connecting the print platen roller 52 and the thermal activation platen roller 62 to the same drive source (the second stepping motor 111) makes it easy to set the platen rollers 52 and 62 to the same transport speed by synchronizing rotation of the two with each other. As a result, transport failures such as bowing of the heat-sensitive adhesive label 70 due to a difference in transport speed thus can be avoided. Moreover, it also simplifies the drive mechanism and therefore the device can be reduced in size.

The thermal activation unit 60 also has pressurizing means (for example, a coil spring or a leaf spring) for pressing the thermal-activation thermal head 61 against the thermal activation platen roller 62. The rotation axis of the thermal activation platen roller 62 is kept parallel to the direction in which the heater elements are aligned, so that the pressure applied to the heat-sensitive adhesive label 70 from the thermal-activation thermal head 61 is made uniform along the entire width of the label 70.

Paper sensors S1, S2 and S3 are placed upstream of the feeders 21 and 22, upstream of the thermal activation platen roller 62, and downstream of the thermal activation unit 60, respectively. The operation of each transporting means, printing processing in the printing unit 50, and thermal activation processing in the thermal activation unit 60 are controlled based on detection of the heat-sensitive adhesive label 70 by the paper sensors S1, S2 and S3.

Figure 2:
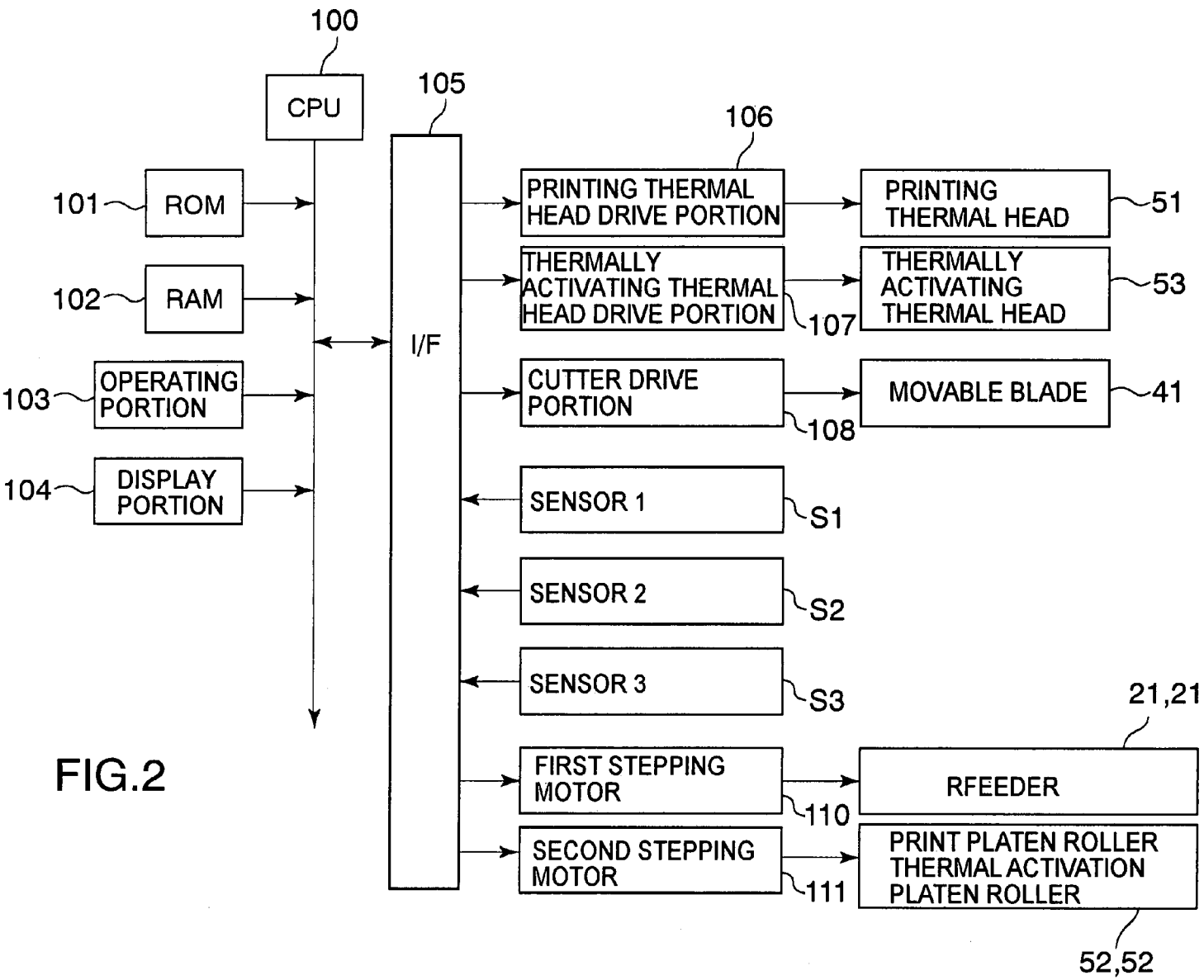
FIG. 2 is a block diagram showing a structural example of a control system according to the first embodiment of the present invention.

FIG. 2 is a control block diagram of the thermal printer P1. A control unit of the thermal printer P1 according to this embodiment is composed of: a CPU 100 serving as a control device which takes overall control of the control unit; a ROM 101 for storing control programs and the like which are implemented by the CPU 100; a RAM 102 for storing various print formats and the like; an operation unit 103 for inputting, setting, or calling up print data, print format data, and the like; a display unit 104 for displaying print data and the like; an interface 105 through which data is inputted and outputted between the control unit and the drive unit; a drive circuit 106 for driving the print thermal head 51; a drive circuit 107 for driving the thermal-activation thermal head 61; a drive circuit 108 for driving the movable blade 31, which cuts the heat-sensitive adhesive label 70; the first stepping motor 110 for driving the paper sensors S1, S2 and S3, which detect the heat-sensitive adhesive label 70, as well as the feeders 21 and 22; the second stepping motor 111 for driving the print platen roller 52 and the thermal activation platen roller 62; and other components.

Based on control signals sent from the CPU 100, the cutter unit 30 carries out cutting processing at given timing, the printing unit 50 executes desired printing processing, and the thermal activation unit 60 performs thermal activation processing on the heat-sensitive adhesive layer.

The CPU 100 is structured such that control signals can be sent to the first stepping motor 110 and to the second stepping motor 111 separately. This makes it possible to control the rotation speed (the speed at which the heat-sensitive adhesive label 70 is transported) of the feeders 21 and 22, which are driven by the first stepping motor 110, and the rotation speed of the print platen roller 52 and the thermal activation platen roller 62, which are driven by the second stepping motor 111, independently of each other.

Figure 3:
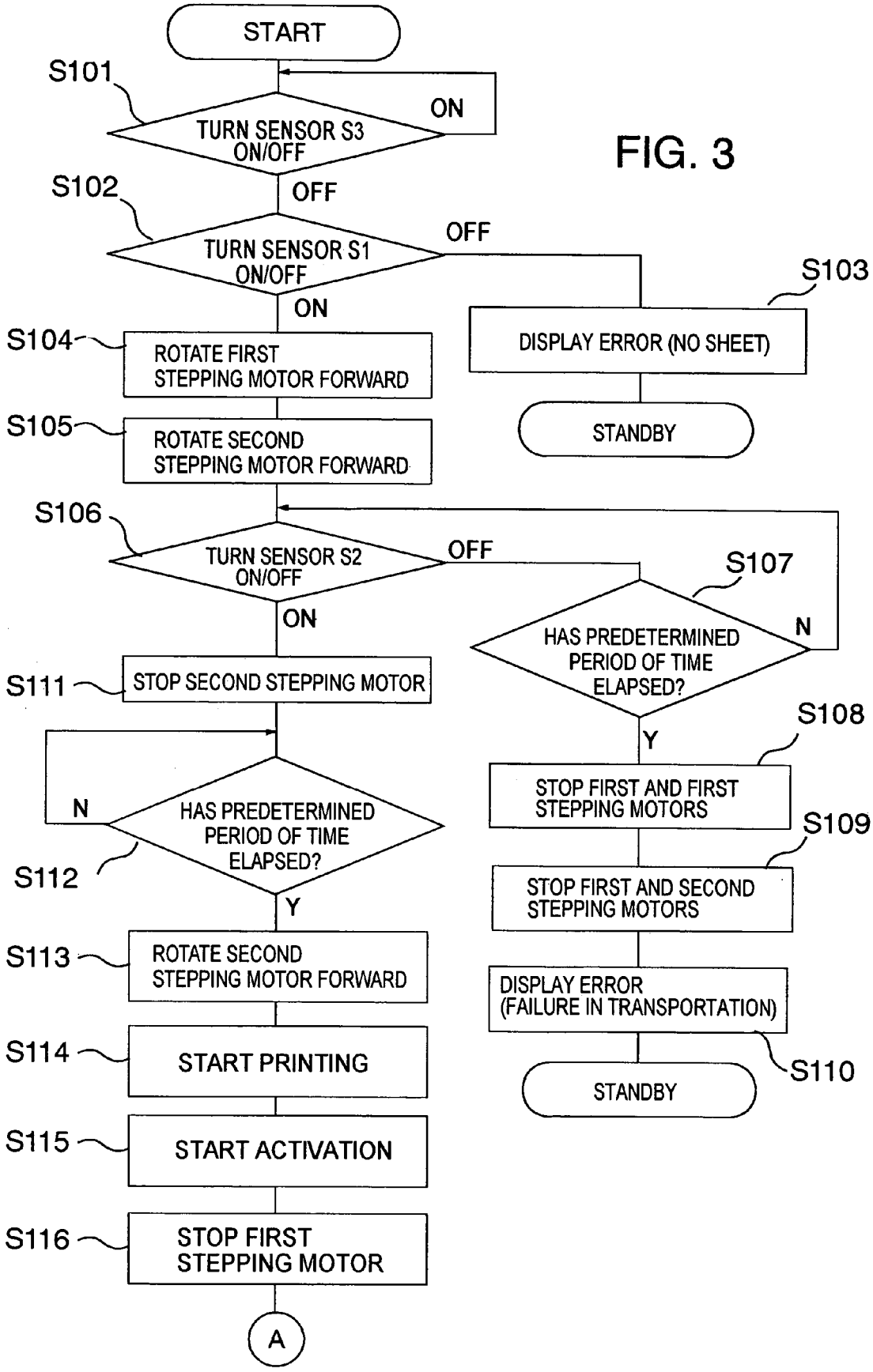
FIG. 3 is a flowchart of printing processing and thermal activation processing in the thermal printer P1.
Figure 4:
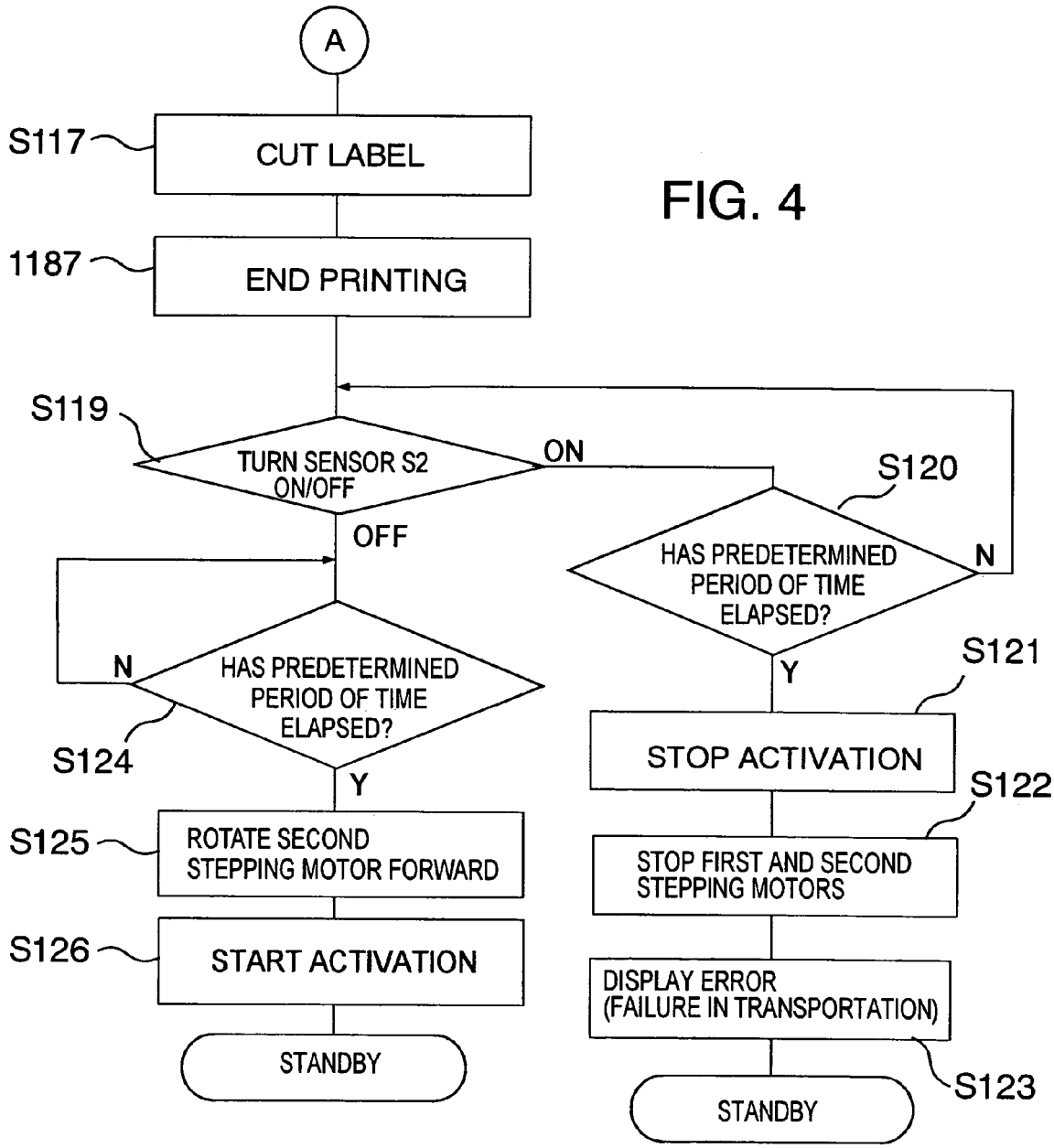
FIG. 4 is a flowchart of printing processing and thermal activation processing in the thermal printer P1.

Next, printing processing and thermal activation processing in the thermal printer P1 are described with reference to flowcharts of FIGS. 3 and 4 and transport state transition diagrams of FIGS. 5A to 5G.

First, a print start command is given by a user and whether the paper sensor S3 is ON or OFF is judged in step S101. When it is judged that the paper sensor S3 is ON, processing of the previous label is not finished yet and the current process is stopped until the paper sensor S3 is turned OFF. On the other hand, when it is judged in step S101 that the paper sensor S3 is OFF, the process proceeds to step S102 to judge whether the paper sensor S1 is ON or OFF.

Figure 5A:
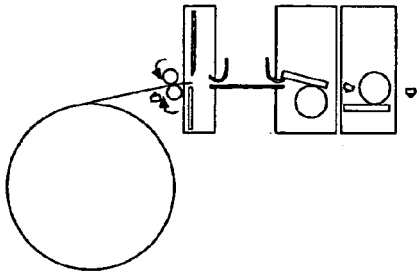
FIGS. 5A to 5G are explanatory diagrams showing a transition of the state of a heat-sensitive adhesive label 70 during transport according to the first embodiment of the present invention.
Figure 5B:
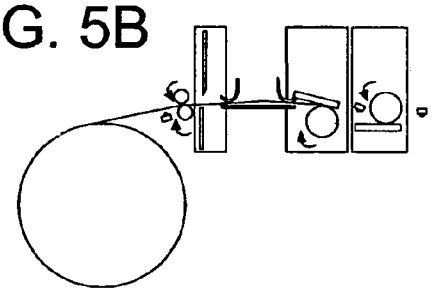

When it is judged in step S102 that the paper sensor S1 is OFF, the heat-sensitive adhesive label 70 is not set and the display unit 104 displays an error message (no paper) to end the process in step S103. On the other hand, when it is judged in step S102 that the sensor S1 is ON, the process proceeds to step S104 to start rotation of the feeders 21 and 22 by rotating the first stepping motor 110 forward. As the feeders 21 and 22 are rotated, the heat-sensitive adhesive label 70 is pulled out at a given transport speed (FIG. 5A). In step S105, the second stepping motor 111 is rotated forward to start rotation of the print platen roller 52 and the thermal activation platen roller 62 in preparation for transport of the heat-sensitive adhesive label 70. When the leading edge of the heat-sensitive adhesive label 70 reaches the print platen roller 52, the heat-sensitive adhesive label 70 is pulled into the gap between the print platen roller 52 and the thermal print head 51 with the transport speed controlled by the rotation speed of the print platen roller 52 (FIG. 5B).

In step S106, whether the paper sensor S2 is ON or OFF is judged and, when the sensor S2 is judged to be OFF, the process proceeds to step S107 to judge whether a predetermined period of time has passed or not. The predetermined period of time here is a time period counted from when the first stepping motor 110 starts rotation driving to a time point where the leading edge of the heat-sensitive adhesive label 70 is predicted to reach the paper sensor 2, for example (a rough estimation can be obtained from the length of a transport path between a cutting position of the cutter unit 30 and the paper sensor S2 and from the number of rotation of the stepping motor). When it is judged in step S107 that the predetermined time period has elapsed, it means that a transport failure such as paper jam has taken place. In this case, in steps S108 and S109, the first stepping motor 110 and the second stepping motor 111 are both stopped to halt the transport of the heat-sensitive adhesive label 70. In step S110, the display unit 104 displays an error message (transport failure) and the process is ended.

Figure 5C:
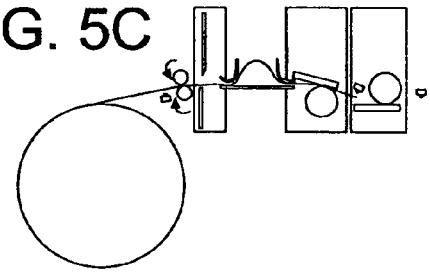

When it is judged in step S106 that the paper sensor S2 is ON, the process proceeds to step S111 to stop the second stepping motor 111 and thereby halt the transport of the heat-sensitive adhesive label 70 by the print platen roller 52. With the print platen roller 52 stopped, the leading edge of the heat-sensitive adhesive label 70 stays still whereas the feeders 21 and 22 keep sending the rest of the label forward. This causes the heat-sensitive adhesive label 70 to bow in the label pooling portion of the guide unit 40 (FIG. 5C).

Whether a predetermined period of time has passed or not is judged in step S112. When it is judged that the predetermined period of time has elapsed, the second stepping motor 111 is rotated forward to resume rotation of the print platen roller 52 and the thermal activation platen roller 62. The predetermined period of time here is the time it takes for the bowed portion of the heat-sensitive adhesive label 70 to become longer than the portion of the label 70 that is transported by the print platen roller 52 and the thermal activation platen roller 62 while the label is being cut by the cutter unit 30. In other words, the heat-sensitive adhesive label 70 is bowed here enough to allow the print platen roller 52 and the thermal activation platen roller 62 to transport the label while the label is being cut.

Figure 5D:
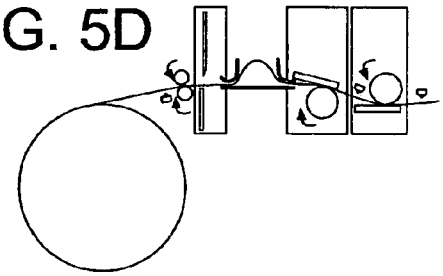

Next, in step S114, the print thermal head drive unit 106 is driven to start printing processing. In step S115, the thermal-activation thermal head drive unit 107 is driven to start the thermal activation processing. At this point, the same amount of the heat-sensitive adhesive label 70 is kept bowed if the transport speed of the feeders 21 and 22 is equal to the transport speed of the print platen roller 52 (FIG. 5D). Although the printing processing in this embodiment is started after rotation driving of the second stepping motor 111 is resumed in step S113, the start of the printing processing may be set to a time point where the heat-sensitive adhesive label 70 passes the print thermal head 51 (for instance, after step S105). In this case, however, transport of the heat-sensitive adhesive label 70 is stopped in the middle of printing, in short, the printing processing is interrupted, and the printing quality could be degraded accordingly.

Figure 5E:
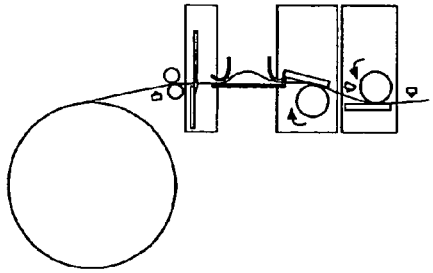
Figure 5F:
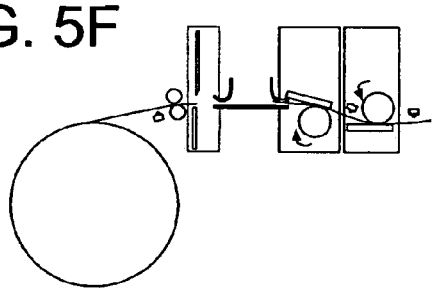

After a given length of the heat-sensitive adhesive label 70 is transported, the first stepping motor 110 is stopped in step S116 to stop transport by the feeders 21 and 22, and the heat-sensitive adhesive label 70 is cut in step S117 (FIG. 5E). Then the heat-sensitive adhesive label 70 is transported by the print platen roller 52 and the thermal activation platen roller 62 (FIG. 5F).

Next, in step S119, whether the paper sensor S2 is ON or OFF is judged and, when it is judged that the sensor S2 is ON, the process proceeds to step S120 to judge whether a predetermined period of time has passed or not. The predetermined period of time here is, for example, a time period counted from when the second stepping motor 111 starts rotation driving (step S113) to a time point where the trailing edge of the heat-sensitive adhesive label 70 is predicted to reach the paper sensor S2 (a rough estimation can be obtained from the length of a path along which the label is transported by the feeders 21 and 22 and from the number of rotation of the stepping motor). When it is judged in step S120 that the predetermined time period has elapsed, it means that a transport failure such as paper jam has taken place. Then, in step S121, the thermal activation processing is stopped and, in step S122, the second stepping motor 111 is stopped to halt the transport of the heat-sensitive adhesive label 70. In step S123, the display unit 104 displays an error message (transport failure) and the process is ended.

Figure 5G:
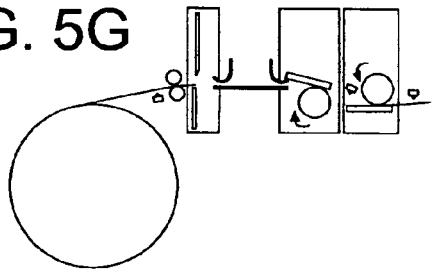

When it is judged in step S119 that the paper sensor S2 is OFF, the process proceeds to step S124 to judge whether a predetermined period of time has elapsed. The predetermined period of time here is a time period counted from a time point where the trailing edge of the heat-sensitive adhesive label 70 passes the paper sensor S2 to a time point where the trailing edge of the label passes the thermal activation platen roller 62 (a rough estimation can be obtained from the length of a transport path between the paper sensor S2 and the thermal activation platen roller 62 and from the number of rotation of the stepping motor). When it is judged in step S124 that the predetermined time period has elapsed, the thermal activation processing is stopped in step S125. In step S126, the second stepping motor 111 is stopped to halt the transport of the heat-sensitive adhesive label 70 and the series of control processing is ended (FIG. 5G).

As has been described, the thermal printer P1 of this embodiment is capable of cutting the heat-sensitive adhesive label 70 in the cutter unit 30 without allowing the label to stay nipped between the thermal-activation thermal head 61 and the thermal activation platen roller 62 while transport of the label is stopped. Therefore, the printer P1 can avoid a situation in which the heat-sensitive adhesive layer of the heat-sensitive adhesive label 70 is stuck to the thermal-activation thermal head 61 to cause transport failures such as paper jam.

SECOND EMBODIMENT

Figure 6:
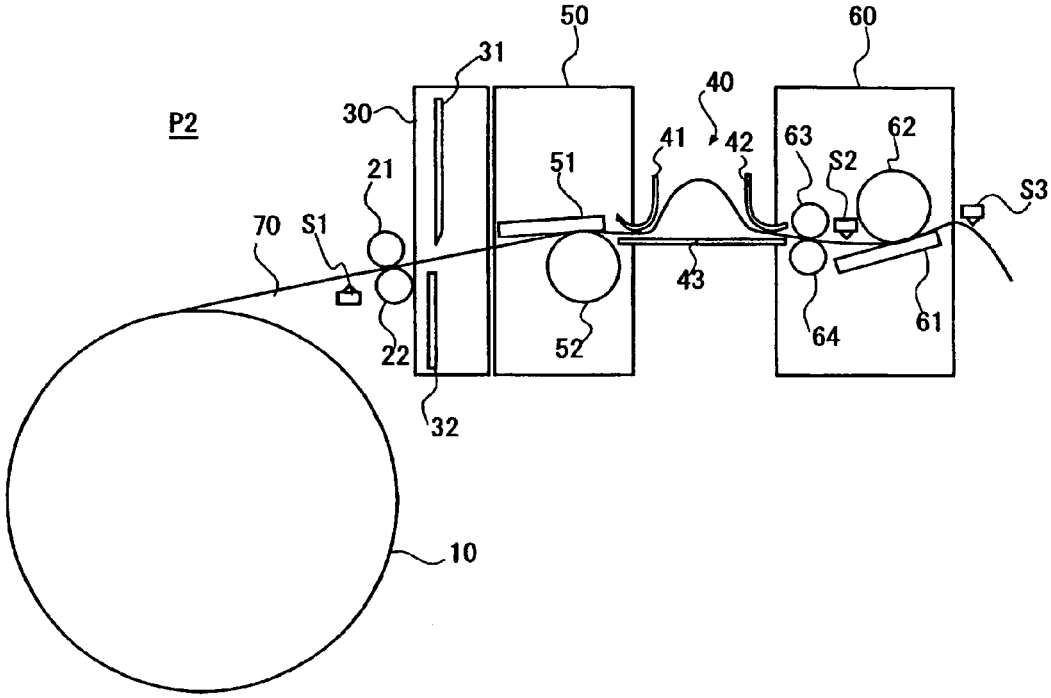
FIG. 6 is a schematic diagram showing a structural example of a thermal printer P2 according to a second embodiment of the present invention.

FIG. 6 is a schematic diagram showing the structure of at thermal printer P2 for a heat-sensitive adhesive sheet according to the second embodiment. Similar to the thermal printer P1 of the first embodiment, the thermal printer P2 is composed of: a roll housing unit 10 for holding a tape-like, heat-sensitive adhesive label 70 wound into a roll; a cutter unit 30 for cutting the heat-sensitive adhesive label 70 into pieces of given length; a printing unit 50 for printing on the heat-sensitive adhesive label 70; a thermal activation unit 60 which serves as a thermal activation device for thermally activating a heat-sensitive adhesive layer of the heat-sensitive adhesive label 70; and other components. Feeders 21 and 22 which are rollers are placed upstream of the cutter unit 30 and are pressed against each other.

A difference between Embodiments 1 and 2 is that, in this embodiment, a guide unit 40 for forming a label pooling portion where the heat-sensitive adhesive label 70 is temporarily bowed is placed along a transport path between the printing unit 50 and the thermal activation unit 60. Another difference is that in this embodiment, pull-in rollers 63 and 64 are provided upstream of a paper sensor S2, so that the heat-sensitive adhesive label 70 is smoothly inserted into the thermal activation unit 60.

A print platen roller 52 is, similar to the feeders 21 and 22, connected to a first stepping motor 110 (see FIG. 7) through a not-shown gear transmission mechanism. A thermal activation roller 62 and the pull-in rollers 63 and 64 are connected to a second stepping motor 111 (see FIG. 7) through a not-shown gear transmission mechanism. Connecting the feeders 21 and 22 and the print platen roller 52 to the same drive source, or connecting the thermal activation platen roller 62 and the pull-in rollers 63 and 64 to the same drive source makes it easy to set the platen rollers 52 and 62 to the same transport speed by synchronizing rotation of the two with each other. As a result, transport failures such as bowing of the heat-sensitive adhesive label 70 due to a difference in transport speed thus can be avoided. It also simplifies the drive mechanism and therefore the device can be reduced in size.

Figure 7:
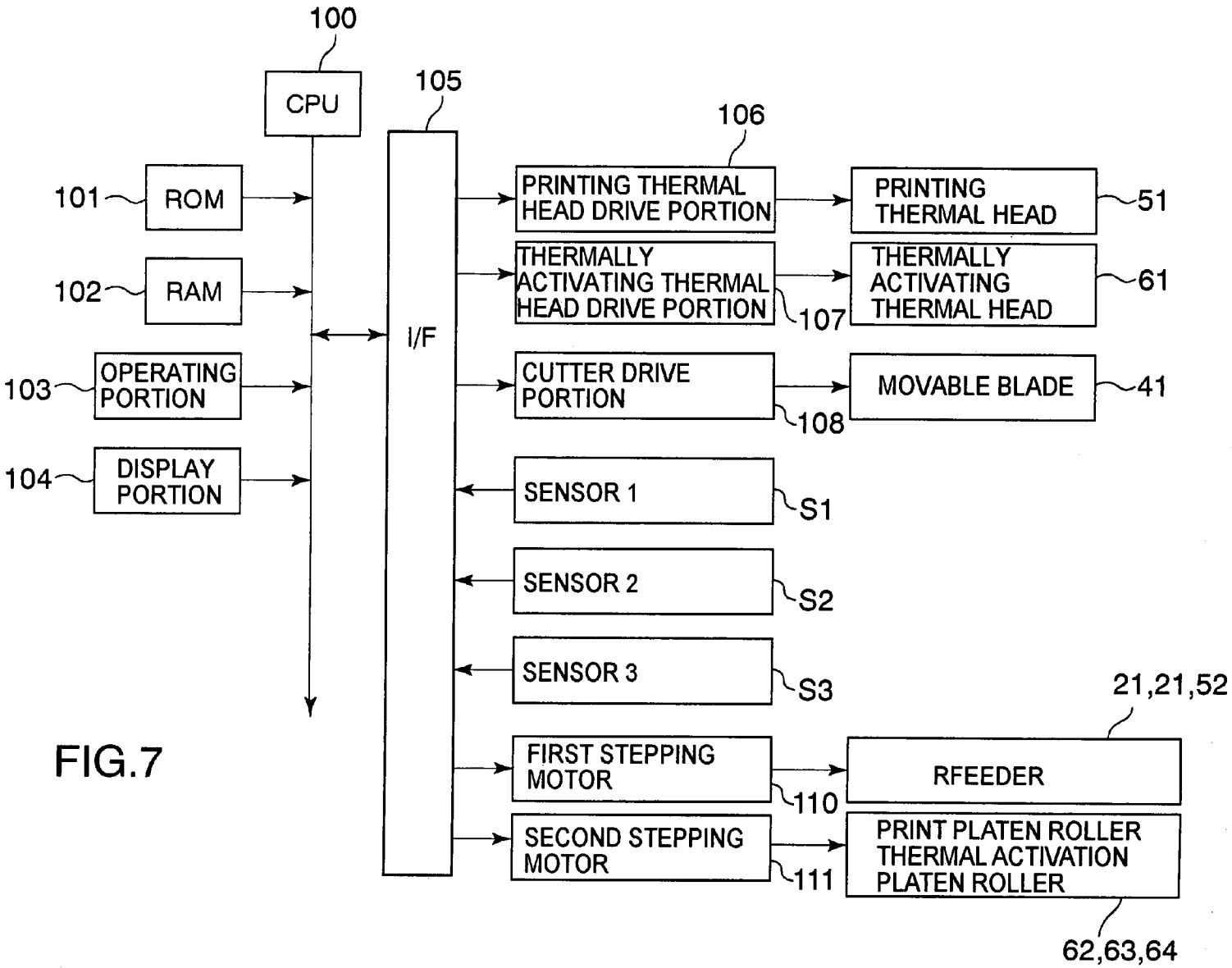
FIG. 7 is a block diagram showing a structural example of a control system according to the second embodiment of the present invention.

FIG. 7 is a control block diagram of the thermal printer P2 and is approximately identical to that of the first embodiment. The feeders 21 and 22 and the print platen roller 52 are connected to the first stepping motor 110 whereas the thermal activation platen roller 62 and the pull-in rollers 63 and 64 are connected to the second stepping motor 111.

Figure 8:
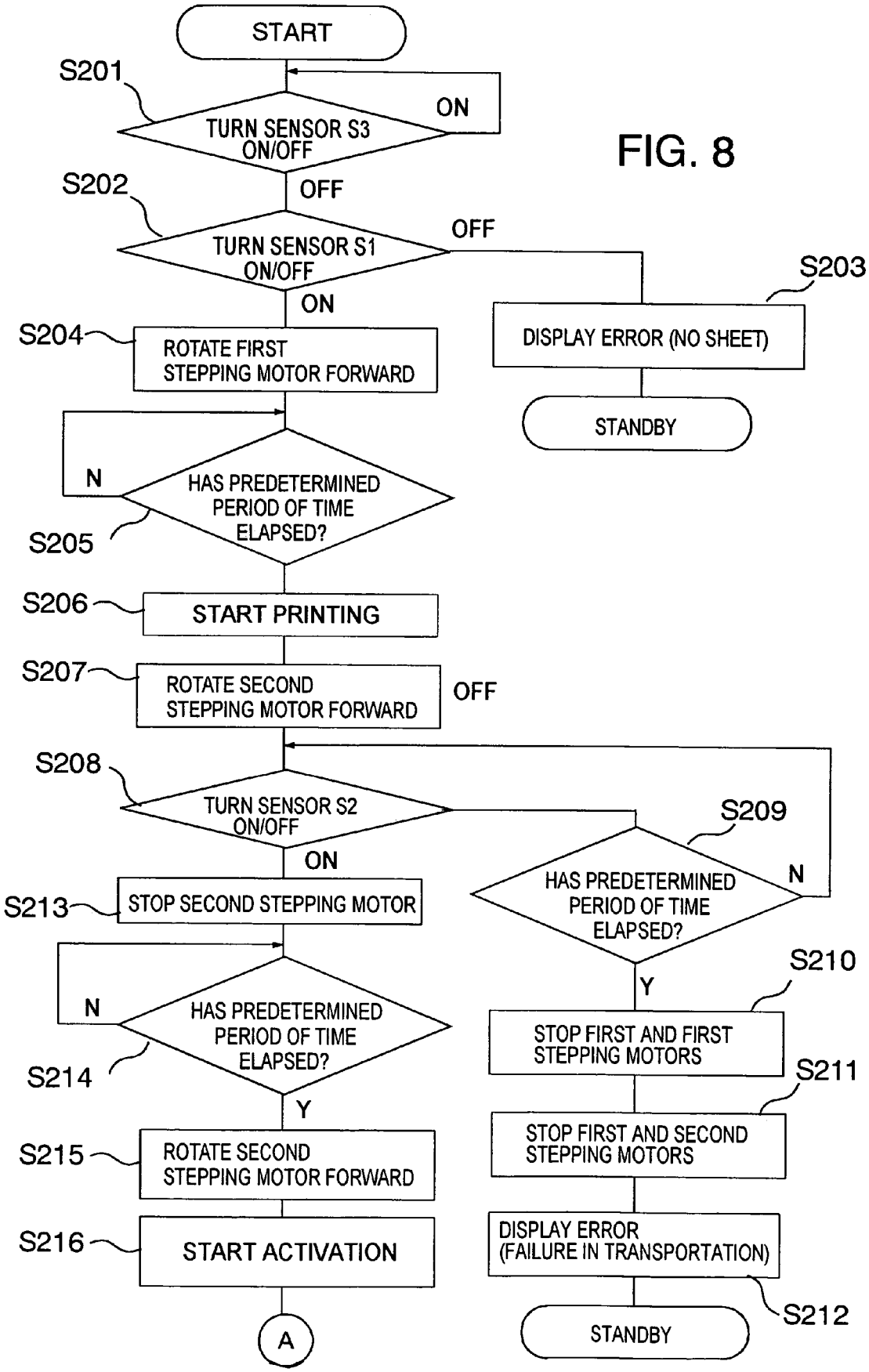
FIG. 8 is a flowchart of printing processing and thermal activation processing in the thermal printer P2.
Figure 9:
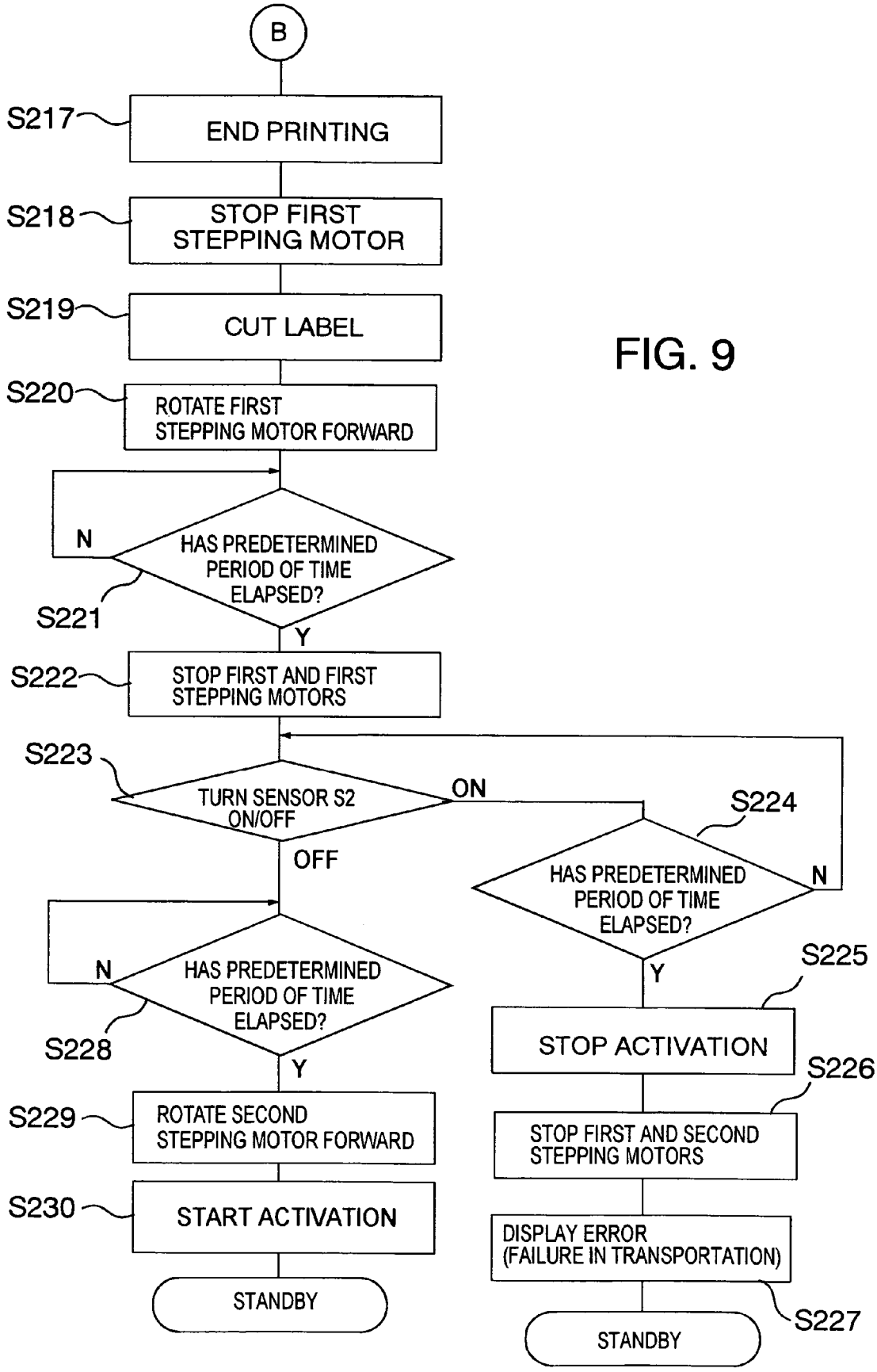
FIG. 9 is a flowchart of printing processing and thermal activation processing in the thermal printer P2.

Printing processing and thermal activation processing in the thermal printer P2 are described next with reference to flowcharts of FIGS. 8 and 9 and transport state transition diagrams of FIGS. 10A to 10G.

First, a print start command is given by a user and whether a paper sensor S3 is ON or OFF is judged in step S201. When it is judged that the paper sensor S3 is ON, processing of the previous label is not finished yet and the current process is stopped until the paper sensor S3 is turned OFF. On the other hand, when it is judged in step S201 that the paper sensor S3 is OFF, the process proceeds to step S202 to judge whether a paper sensor S1 is ON or OFF.

Figure 10A:
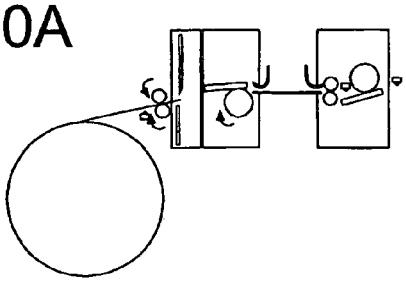
FIGS. 10A to 10G are explanatory diagrams showing a transition of the state of a heat-sensitive adhesive label 70 during transport according to the second embodiment of the present invention.

When it is judged in step S202 that the paper sensor S1 is OFF, the heat-sensitive adhesive label 70 is not set and the display unit 104 displays an error message (no paper) to end the process in step S203. On the other hand, when it is judged in step S202 that the sensor S1 is ON, the process proceeds to step S204 to start rotation of the feeders 21 and 22 as well as the print platen roller 52 by rotating the first stepping motor 110 forward. As the feeders 21 and 22 and the print platen roller 52 are rotated, the heat-sensitive adhesive label 70 is pulled out at a given transport speed (FIG. 10A). In step S205, whether a predetermined period of time has passed or not is judged. When it is judged that the predetermined period of time has elapsed, the process proceeds to step S206 to drive a thermal print head drive unit 106 and start printing processing. The predetermined period of time here is, for example, a time period counted from when the first stepping motor 110 starts rotation driving to a time point where the leading edge of the heat-sensitive adhesive label 70 is predicted to reach the thermal print head 51 (a rough estimation can be obtained from the length of a transport path between a cutting position of the cutter unit 30 and the thermal print head 51 and from the number of rotation of the stepping motor).

Figure 10E:
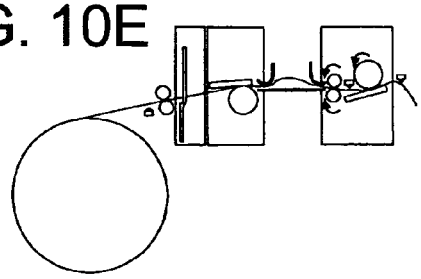
Figure 10B:
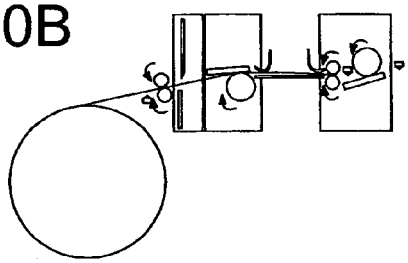

Next, in step S207, the second stepping motor 111 is rotated forward to start rotation of the pull-in rollers 63 and 64 and the thermal activation platen roller 62 in preparation for transport of the heat-sensitive adhesive label 70. When the leading edge of the heat-sensitive adhesive label 70 reaches the pull-in rollers 63 and 64, the heat-sensitive adhesive label 70 is pulled into the gap between the pull-in rollers 63 and 64 with the transport speed controlled by the rotation speed of the pull-in rollers 63 and 64 and of the print platen roller 52 (FIG. 10B).

Next, in step S208, whether the paper sensor S2 is ON or OFF is judged and, when it is judged that the sensor S2 is OFF, the process proceeds to step S209 to judge whether a predetermined period of time has passed or not. The predetermined period of time here is, for example, a time period counted from when the first stepping motor 110 starts rotation driving to a time point where the leading edge of the heat-sensitive adhesive label 70 is predicted to reach the paper sensor S2 (a rough estimation can be obtained from the length of a transport path between a cutting position of the cutter unit 30 and the paper sensor S2 and from the number of rotation of the stepping motor). When it is judged in step S209 that the predetermined time period has elapsed, it means that transport failures such as paper jam have taken place. Then, the thermal activation processing is stopped and the first stepping motor 110 and the second stepping motor 111 are stopped to halt the transport of the heat-sensitive adhesive label 70 (S210 and S211). In step S212, the display unit 104 displays an error message (transport failure) and the process is ended.

Figure 10F:
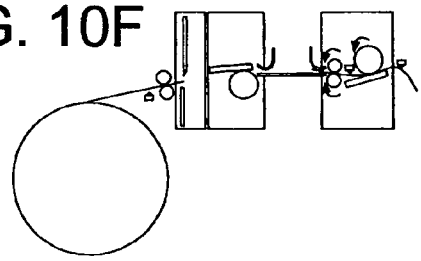
Figure 10C:
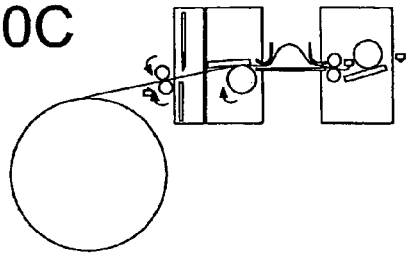

When it is judged in step S208 that the paper sensor S2 is ON, the process proceeds to step S213 to stop the second stepping motor 111 and thereby halt the transport of the heat-sensitive adhesive label 70 by the pull-in rollers 63 and 64. With the print pull-in rollers 63 and 64 stopped, the leading edge of the heat-sensitive adhesive label 70 stays still whereas the feeders 21 and 22 and the print platen roller 52 keep sending the rest of the label forward. This causes the heat-sensitive adhesive label 70 to bow in a label pooling portion of the guide unit 40 (FIG. 10C).

Whether a predetermined period of time has passed or not is judged in step S214. When it is judged that the predetermined period of time has elapsed, the second stepping motor 111 is rotated forward in step S215 to resume rotation of the pull-in rollers 63 and 64 and of the thermal activation platen roller 62. The predetermined period of time here is the period of time it takes for the bowed portion of the heat-sensitive adhesive label 70 to become longer than the portion of the label 70 that is transported by the pull-in rollers 63 and 64 and the thermal activation platen roller 62 while the label is being cut by the cutter unit 30. In other words, the heat-sensitive adhesive label 70 is bowed here enough to allow the pull-in rollers 63 and 64 and the thermal activation platen roller 62 to transport the label while the label is being cut.

Figure 10G:
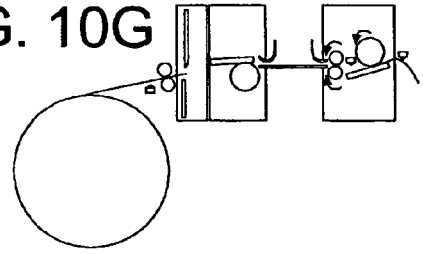
Figure 10D:
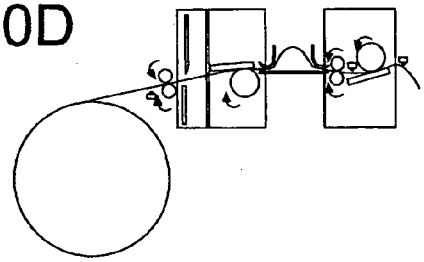
Figure 11:
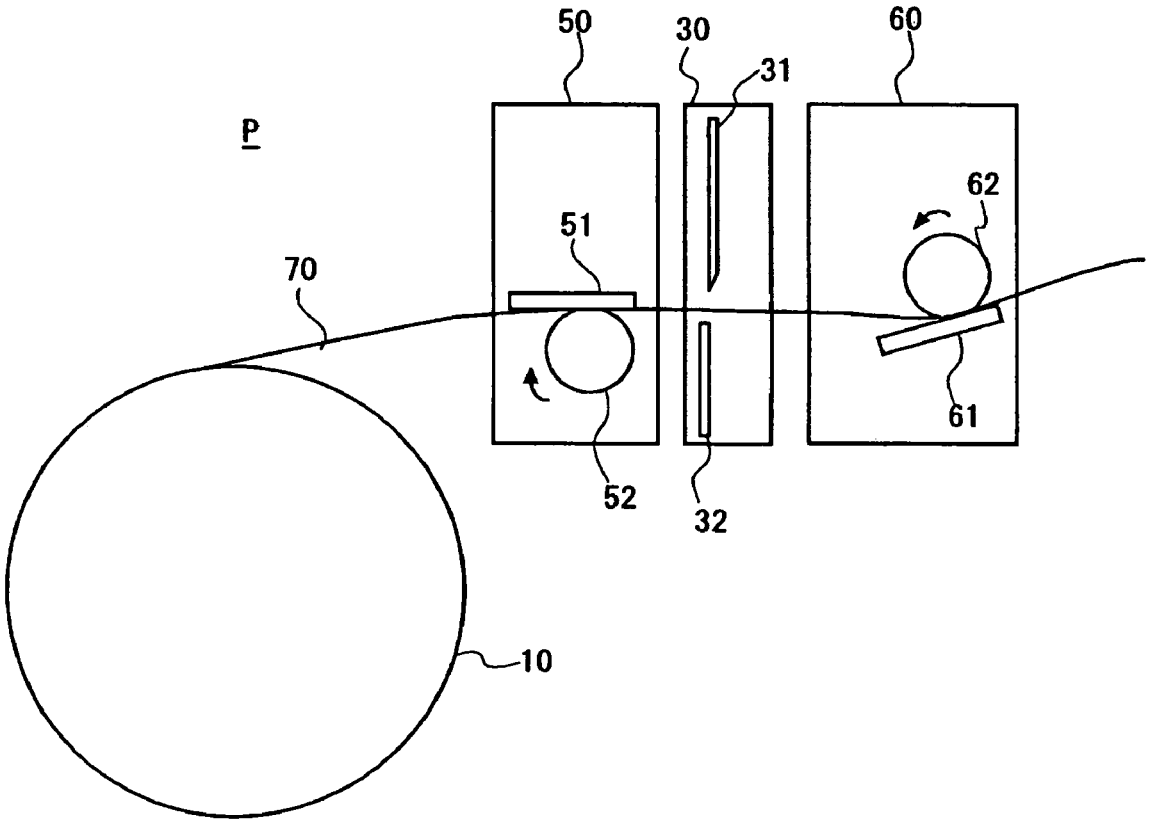
FIG. 11 is a schematic diagram showing a structural example of a conventional thermal printer P.

Next, in step S216, the drive circuit 107 is driven to start thermal activation processing. At this point, the same amount of the heat-sensitive adhesive label 70 is kept bowed if the transport speed of the feeders 21 and 22 and of the print platen roller 52 is equal to the transport speed of the pull-in rollers 63 and 64 and of the thermal activation platen roller 62 (FIG. 10D).

After a given length of the heat-sensitive adhesive label 70 is transported, the printing processing is ended in step S217. The first stepping motor 110 is stopped in step S218 to stop transport of the heat-sensitive adhesive label 70 by the feeders 21 and 22 and by the print platen roller 52. The heat-sensitive adhesive label 70 is cut in step S219 (FIG. 10E).

Although the label is cut after the printing processing is ended in step S217 in this embodiment, the printing processing may be resumed after the label is cut. In this case, however, the printing processing is interrupted, and the printing quality could be degraded accordingly.

In step S220, the first stepping motor 110 is rotated forward to resume the transport of the heat-sensitive adhesive label 70 by the print platen roller 52. Whether a predetermined period of time has passed or not is judged in step S211. When it is judged that the predetermined period of time has elapsed, the process proceeds to step S212 to stop the first stepping motor 110. The predetermined period of time here is, for example, a time period counted from when the first stepping motor 110 starts rotation driving (step S220) to a time point where the trailing edge of the heat-sensitive adhesive label 70 is predicted to reach the thermal print head 51 (a rough estimation can be obtained from the length of a transport path between the cutting position of the cutter unit 30 and the thermal print head 51 and from the number of rotation of the stepping motor). Thereafter, the heat-sensitive adhesive label 70 is transported by the pull-in rollers 63 and 64 and the thermal activation platen roller 62 (FIG. 10F).

In step S223, whether the paper sensor S2 is ON or OFF is judged and, when it is judged that the sensor S2 is ON, the process proceeds to step S235 to judge whether a predetermined period of time has passed or not. The predetermined period of time here is, for example, a time period counted from when the second stepping motor 111 starts rotation driving (step S215) to a time point where the trailing edge of the heat-sensitive adhesive label 70 is predicted to reach the paper sensor 2 (a rough estimation can be obtained from the length of a path along which the label is transported by the feeders 21 and 22 and from the number of rotation of the stepping motor). When it is judged in step S224 that the predetermined time period has elapsed, it means that transport failures such as paper jam have taken place. Then, in step S225, the thermal activation processing is stopped and, in step S226, the second stepping motor 111 is stopped to halt the transport of the heat-sensitive adhesive label 70. In step S227, the display unit 104 displays an error message (transport failure) and the process is ended.

When it is judged in step S223 that the paper sensor S2 is OFF, the process proceeds to step S228 to judge whether a predetermined period of time has elapsed. The predetermined period of time here is a time period counted from a time point where the trailing edge of the heat-sensitive adhesive label 70 passes the paper sensor S2 to a time point where the trailing edge of the label passes the thermal activation platen roller 62 (a rough estimation can be obtained from the length of a transport path between the paper sensor S2 and the thermal activation platen roller 62 and from the number of rotation of the stepping motor). When it is judged in step S228 that the predetermined time period has elapsed, the thermal activation processing is stopped in step S229. In step S230, the second stepping motor 111 is stopped to halt the transport of the heat-sensitive adhesive label 70 and the series of control processing is ended (FIG. 10G).

As has been described, the thermal printer P2 of this embodiment is capable of cutting the heat-sensitive adhesive label 70 in the cutter unit 30 without allowing the label to stay nipped between the thermal-activation thermal head 61 and the thermal activation platen roller 62 while transport of the label is stopped. Therefore, the printer P2 can avoid a situation in which the heat-sensitive adhesive layer of the heat-sensitive adhesive label 70 is stuck to the thermal-activation thermal head 61 to cause transport failures such as paper jam.

Given above based on embodiments is a specific description of the invention made by the present inventors. However, the present invention is not limited to the above embodiments and various modifications are possible without departing from the spirit of the present invention.

For instance, the guide unit 40, which is provided in the above embodiments to form a label pooling portion between the cutter unit 30 and the printing unit 50 or between the printing unit 50 and the thermal activation unit 60, may be provided in each of these two sections.

The method employed in the above embodiments to bow the heat-sensitive adhesive label 70 is to temporarily stop the transporting means that is positioned downstream of the label pooling portion (the print platen roller 52 in the first embodiment and the pull-in rollers 63 and 64 in the second embodiment). However, to make the heat-sensitive adhesive label 70 bow, stopping the operation of the transporting means completely is not necessary and it is sufficient if the transport speed is controlled such that the label is transported at a slower speed than when transported by transporting means that is upstream of the label pooling portion.

A printer according to the present invention may be structured such that the distance between the cutter unit 30 and the printing unit 50 and the distance between the printing unit 50 and the thermal activation unit 60 can be changed. This enables the printer to handle labels of varying lengths and labels can be cut into any length desired. The distance between the units 30 and 50 and the distance between the units 50 and 60 can be adjusted by, for example, providing a guiding jig such as a rail in the heat-sensitive adhesive sheet transporting direction to enable the cutter device and the thermal activation device to slide in the sheet transporting direction. Another example of adjusting the distances is to make the cutter device and the thermal activation device movable in the vertical direction.

The above embodiments show an application of the present invention to thermal transfer printing apparatus such as a thermal printer. However, the present invention is also applicable to ink-jet printers, laser printers, and others. In this case, a printable surface of a label is prepared in accordance with the printing method employed instead of having a heat-sensitive print layer.

According to the present invention, the printer for a heat-sensitive adhesive sheet includes: a sheet housing unit for storing a heat-sensitive adhesive sheet with a sheet-like base material one side of which has a heat-sensitive adhesive layer formed thereon and the other side of which serves as a printable surface; pull-out rollers for pulling the heat-sensitive adhesive sheet out of the sheet housing unit to transport the sheet in a given direction; a cutter device placed downstream of the pull-out rollers and having cutting means which cuts the heat-sensitive adhesive sheet that has been transported by the pull-out rollers; a printing device placed downstream of the cutter device and having a thermal print head and a print platen roller, the thermal print head being provided to print letters or images on the printable surface of the heat-sensitive adhesive sheet, the print platen roller transporting the heat-sensitive adhesive sheet in a given direction; a thermal activation device placed downstream of the printing device and having a thermal-activation thermal head and a thermal activation platen roller, the thermal-activation thermal head heating the heat-sensitive adhesive layer, the thermal activation platen roller transporting the heat-sensitive adhesive sheet in a given direction; a sheet pooling portion placed between the cutter device and the printing device and having a space in which a given length of the heat-sensitive adhesive sheet is bowed; a first drive means for driving the pull-out rollers; a second drive means for driving the print platen roller; and a drive control device which can control the first drive means and the second drive means independently of each other. Consequently, it is possible to make a heat-sensitive adhesive sheet bow temporarily in the sheet pooling portion by controlling the transport speed of the pull-out roller and of the print roller appropriately, so that a portion of the sheet that is bowed in the sheet pooling portion is sent forward by the print platen roller while the heat-sensitive adhesive sheet is being cut. Therefore, only the pull-out rollers have to stop its operation to cut the sheet.

This enables the cutter device to cut a heat-sensitive adhesive sheet while the sheet is transported by the thermal activation platen roller or before the leading edge of the heat-sensitive adhesive sheet reaches the thermal-activation thermal head. The present invention thus has effects of solving problems such as paper jam that is caused by a heat-sensitive adhesive sheet stuck to the thermal-activation thermal head and eliminating additional maintenance works to remove the jammed sheet (label).

What is claimed is:

1. A printer for a heat-sensitive adhesive sheet, comprising:

a sheet housing unit for storing a heat-sensitive adhesive sheet with a sheet-like base material one side of which has a heat-sensitive adhesive layer formed thereon and the other side of which serves as a printable surface;

pull-out rollers for pulling the heat-sensitive adhesive sheet out of the sheet housing unit to transport the sheet in a given direction;

a cutter device placed downstream of the pull-out rollers and having cutting means which cuts the heat-sensitive adhesive sheet that has been transported by the pull-out rollers;

a printing device placed downstream of the cutter device and having a thermal print head and a print platen roller, the thermal print head being provided to print letters or images on the printable surface of the heat-sensitive adhesive sheet, the print platen roller transporting the heat-sensitive adhesive sheet in the given direction;

a thermal activation device placed downstream of the printing device and having a thermal-activation thermal head and a thermal activation platen roller, the thermal-activation thermal head heating the heat-sensitive adhesive layer, the thermal activation platen roller transporting the heat-sensitive adhesive sheet in the given direction;

a sheet pooling portion placed between the cutter device and the printing device and having a space in which a given length of the heat-sensitive adhesive sheet is bowed;

a first drive means for driving the pull-out rollers;

a second drive means for driving the print platen roller; and a drive control device which can control the first drive means and the second drive means independently of each other.

2. A printer for a heat-sensitive adhesive sheet according to claim 1, wherein the thermal activation platen roller is connected to the second drive means.

3. A printer for a heat-sensitive adhesive sheet according to claim 1, further comprising detecting means which is placed upstream of the thermal activation platen roller to detect the heat-sensitive adhesive sheet.

4. A printer for a heat-sensitive adhesive sheet, comprising:

a sheet housing unit for storing a heat-sensitive adhesive sheet with a sheet-like base material one side of which has a heat-sensitive adhesive layer formed thereon and the other side of which serves as a printable surface;

pull-out rollers for pulling the heat-sensitive adhesive sheet out of the sheet housing unit to transport the sheet in a given direction;

a cutter device placed downstream of the pull-out rollers and having cutting means which cuts the heat-sensitive adhesive sheet that has been transported by the pull-out rollers;

a printing device placed downstream of the cutter device and having a thermal print head and a print platen roller, the thermal print head being provided to print letters or images on the printable surface of the heat-sensitive adhesive sheet, the print platen roller transporting the heat-sensitive adhesive sheet in the given direction;

a thermal activation device placed downstream of the printing device and having a thermal-activation thermal head and a thermal activation platen roller, the thermal-activation thermal head heating the heat-sensitive adhesive layer, the thermal activation platen roller transporting the heat-sensitive adhesive sheet in the given direction;

a sheet pooling portion placed between the cutter device and the printing device and having a space in which a given length of the heat-sensitive adhesive sheet is bowed;

a first drive means for driving the print platen roller;

a second drive means for driving the thermal activation platen roller; and a drive control device which can control the first drive means and the second drive means independently of each other.

5. A printer for a heat-sensitive adhesive sheet according to claim 4, wherein the pull-out rollers are connected to the second drive means.

6. A printer for a heat-sensitive adhesive sheet according to claim 4, further comprising pull-in rollers which are placed upstream of the thermal activation platen roller to transport the heat-sensitive adhesive sheet in the given direction.

7. A printer for a heat-sensitive adhesive sheet according to claim 6, wherein the pull-in rollers are connected to the second drive means.

8. A printer for a heat-sensitive adhesive sheet according to claim 4, further comprising detecting means which is placed upstream of the thermal activation platen roller to detect the heat-sensitive adhesive sheet.

* * * * *